US006499321B1

(12) United States Patent
Rhodes et al.

(10) Patent No.: US 6,499,321 B1
(45) Date of Patent: Dec. 31, 2002

(54) LAUNDRY MACHINE AND/OR METHODS

(75) Inventors: David Charles Rhodes, Auckland (NZ); Adam John Darby, Auckland (NZ)

(73) Assignee: Fisher & Paykel Limited, Auckland (NL)

( * ) Notice: Subject to any disclaimer, the term of this patent is extended or adjusted under 35 U.S.C. 154(b) by 87 days.

(21) Appl. No.: 09/733,471

(22) Filed: Dec. 8, 2000

(30) Foreign Application Priority Data

Dec. 8, 1999 (NZ) ..... 501657

(51) Int. Cl.[7] ..... D06F 33/02
(52) U.S. Cl. ..... 68/12.03; 68/12.22
(58) Field of Search ..... 68/12.03, 12.22; 236/12.11, 12.12, 12.14, 12.15

(56) References Cited

U.S. PATENT DOCUMENTS 4,147,297 A * 4/1979 Worst ..... 68/12.22 X
5,255,844 A 10/1993 Miller et al.
6,003,182 A * 12/1999 Song ..... 68/12.22 X

* cited by examiner

*Primary Examiner*—Philip R. Coe
(74) *Attorney, Agent, or Firm*—Trexler, Bushnell, Giangiorgi, Blackstone & Marr, Ltd.

(57) ABSTRACT

A laundry machine has a wash enclosure to which a supply of water is admitted through a hot water valve and a cold water valve. A temperature sensor senses the temperature of the combined water flow from the hot and cold valves or the temperature of the water collected in the water enclosure. The hot and cold water valves are preferably controlled in accordance with a programme executed on a microprocessor. In a wash operation the controller opens the hot water valve and monitors the temperature indicated by the temperature sensor. The controller only opens the cold valve once the sensed temperature has reached or exceeded a threshold temperature. The effect of the cold water contained in the hot water pipes of a household water supply on wash temperature or wash volume is reduced.

20 Claims, 2 Drawing Sheets

LAUNDRY MACHINE AND/OR METHODS

BACKGROUND TO THE INVENTION i) Field of the Invention

The present invention relates to laundry machines and/or methods of operation of laundry machines, and in particular to improvements in the admission of water thereto.

ii) Summary of the Prior Art

In a laundry machine, whether a horizontal axis or vertical axis type machine, the machine performs a series of cycles, usually beginning with a wash cycle, proceeding through one or more rinse cycles and ending with a spin cycle. In the wash cycle water is admitted to the machine, usually to a tub or other water container within which a perforated drum or bowl rotates and contains the laundry. The wash cycle may fill or partially fill a container to submerge the washing load in a deep wash, or a lesser volume of water may be admitted and this may be recirculated through the laundry load by a recirculation pump and appropriate spray nozzle. These washing methods are well known in the art for both horizontal axis and vertical axis machines.

It is recognised that the recirculation type washing method uses significantly lower volumes of water, particularly in a vertical axis machine. Furthermore it is thought that the greater detergent concentration in the wash liquid during a recirculating type wash leads to better soil removal and/or lower total detergent usage. Accordingly a relation type wash is becoming a preferred wash particularly for vertical axis machines, Horizontal axis machines, by virtue of their nature tend to already have a low water volume in the water container with the clothes being dipped through the water pool by rotation of the horizontally aligned perforated drum.

For proper detergent activation without potentially damaging clothes which are susceptible, for example, to shrinkage or dye loss, it is necessary to have accurate control of the temperature of the body of wash liquid that is in the machine. With the significantly reduced volumes in the machine this is made significantly more difficult if there are fluctuations in the temperature of the water supply.

SUMMARY OF THE INVENTION

It is therefore an object of the present invention to provide a laundry machine and/or methods for the operation of a laundry machine which go someway towards overcoming the above disadvantages or which will at least provide the public with a useful choice.

In a first aspect the invention consists in a laundry machine including a washing enclosure to which a supply of water is admitted in use, first and second valve means for connection to hot and cold water supply sources respectively, temperature sensing means which sense the temperature of either a combined water flow from the first and second valves or the water collected in the water enclosure, and a controller which, in a washing operation, executes an initial fill program comprising the steps of opening only the hot water valve and monitoring the temperature indicated by the temperature sensing means, followed by a warm fill program once the sensed temperature has reached or exceeded a threshold temperature.

In a second aspect the invention consists in a laundry machine including a washing enclosure to which a supply of water is admitted in use, first and second valve means for connection to hot and cold water supply sources respectively, temperature sensing means which sense the temperature of either a combined water flow from the first and second valves or the water collected in the water enclosure, and control means which, in a washing operation, perform the steps of opening the hot water valve and monitoring the temperature indicated by the temperature sensing means, and only opening the cold valve once the sensed temperature has reached or exceeded a threshold temperature is calculated based on the initial temperature of the supply of water flowing through said first valve.

In a third aspect the invention consists in a laundry machine including a washing enclosure to which a supply of water is admitted in use, first and second valve means for connection to hot and cold water supply sources respectively, temperature sensing means which sense the temperature of either a combined water flow from the first and second valves or the water collected in the water enclosure, and control means which, in a washing operation, perform the steps of determining a wash temperature, opening the hot water valve and monitoring the temperature indicated by the temperature sensing means, and only opening the cold valve once the sensed temperature has reached or exceeded a threshold temperature, said threshold temperature being less than said wash temperature.

BRIEF DESCRIPTION OF THE DRAWINGS

One preferred form of the present invention will now be described with reference to the accompanying drawings in which.

DETAILED DESCRIPTION

The present invention recognises that the primary factor in fluctuation of the temperature in a water supply is caused by the water contained in the length of plumbing between the washing machine entry valves and the water heater. Furthermore where an on demand heater is used, for example, an on demand gas heater, the time for activation and heat build up will also be a factor. These factors manifest themselves as a "cold slug" of cold water which enters through the hot water valve prior to the hot water being received.

While in past appliances using for example, deep wash cycles this has not been of particular significance, it has been found that with low water volumes, for example used in concentrated detergent wash recirculation cycles and the like, the presence of the cold slug can greatly inhibit the temperature of the total volume of wash liquid entering the machine from reaching the desired wash temperature.

By way of example, it has been found that the cold slug will generally be between 2–5 litres of water at the ambient temperature, but can be as high as 8 litres. A traditional wash cycle in a fully loaded vertical axis washing machine would see approximately between 55 and 75 litres of water provided to the wash tub. A traditional wash phase in a horizontal axis machine would see approximately between 30 and 40 litres of water admitted to the wash tub. By way of comparison in a concentrated detergent recirculation type wash only between 20 and 30 litres of water may be admitted to the wash tub.

Consequently if in a recirculation type wash both the hot and cold valves are initially open to provide as quick a fill as possible (which has generally been considered most desirable in the past) then, assuming that the water pressure of both the hot and cold supply is equal (where in fact the pressure of the cold water supply is usually significantly above the pressure of the hot water supply where mains pressure hot water systems are not in use) from 2–16 litres of cold water may be admitted to the wash tub before any hot water begins to flow into the machine. If, for example, only 25 litres of water is being admitted to the machine this may lead to 30–100% less hot water entering the machine tan was intended.

Accordingly in the present invention operation of the cold valve is delayed until at least after the transition from cold slug to hot water flow has been detected. It is possible also that at that time the selected relative opening of the hot and cold valve may be adjusted to compensate for the volume of the cold slug as indicated by the duration of the cold slug.

Figure 1:
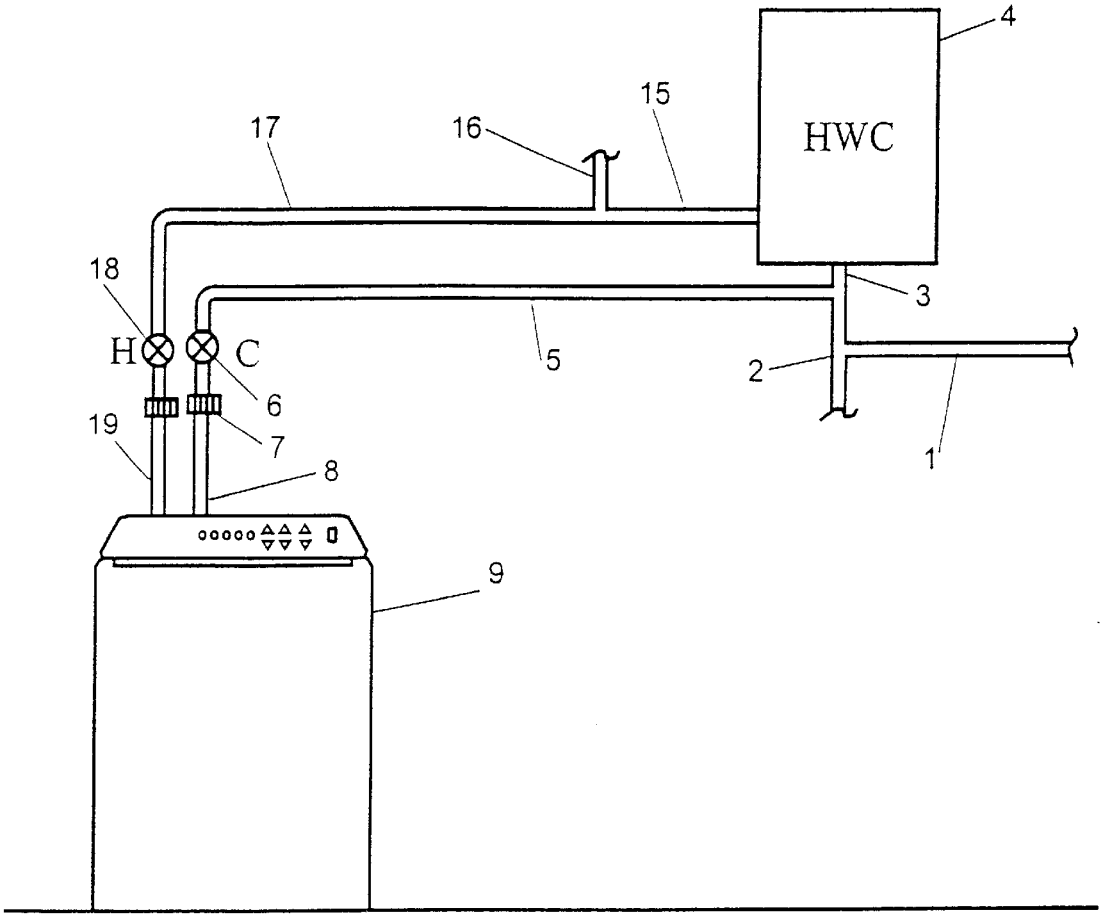
FIG. 1 is a basic diagram of a household water supply system including a hot water cylinder and a washing machine.

Referring to FIG. 1 this depicts a basic model of a household water supply system. Mains water is supplied to the supply system via an inlet pipe 1. This mains supply is a cold water supply and supplies the cold water distribution network more or less directly, as indicated by a branch 2 of the cold water system. A further branch 3 of the cold water system leads to a hot water heater 4, which may be for example an electrical or gas fired hot water boiler or in line heater, such as, an electrical or gas hot water cylinder 4. A farther branch 5 of the cold water system leads to a cold water tap 6 connected via connection 7 to the inlet hose 8 of the washing machine 9. The hot water cylinder 4 has an outlet pipe 15 to the hot water distribution system, for example including branches 16 to the rest of the system and 17 to the laundry hot tap 18 which is connected via hot water inlet hose 19 to the washing machine 9.

With the hot water in at least pipe 17, and also perhaps in pipe 15 depending on usage of water from the remainder 16 of the hot water distribution, being in a basically stationary condition within the pipes, heat is lost from this water to the surrounding ambient environment and the water eventually reaches a more or less cold condition.

Figure 2:
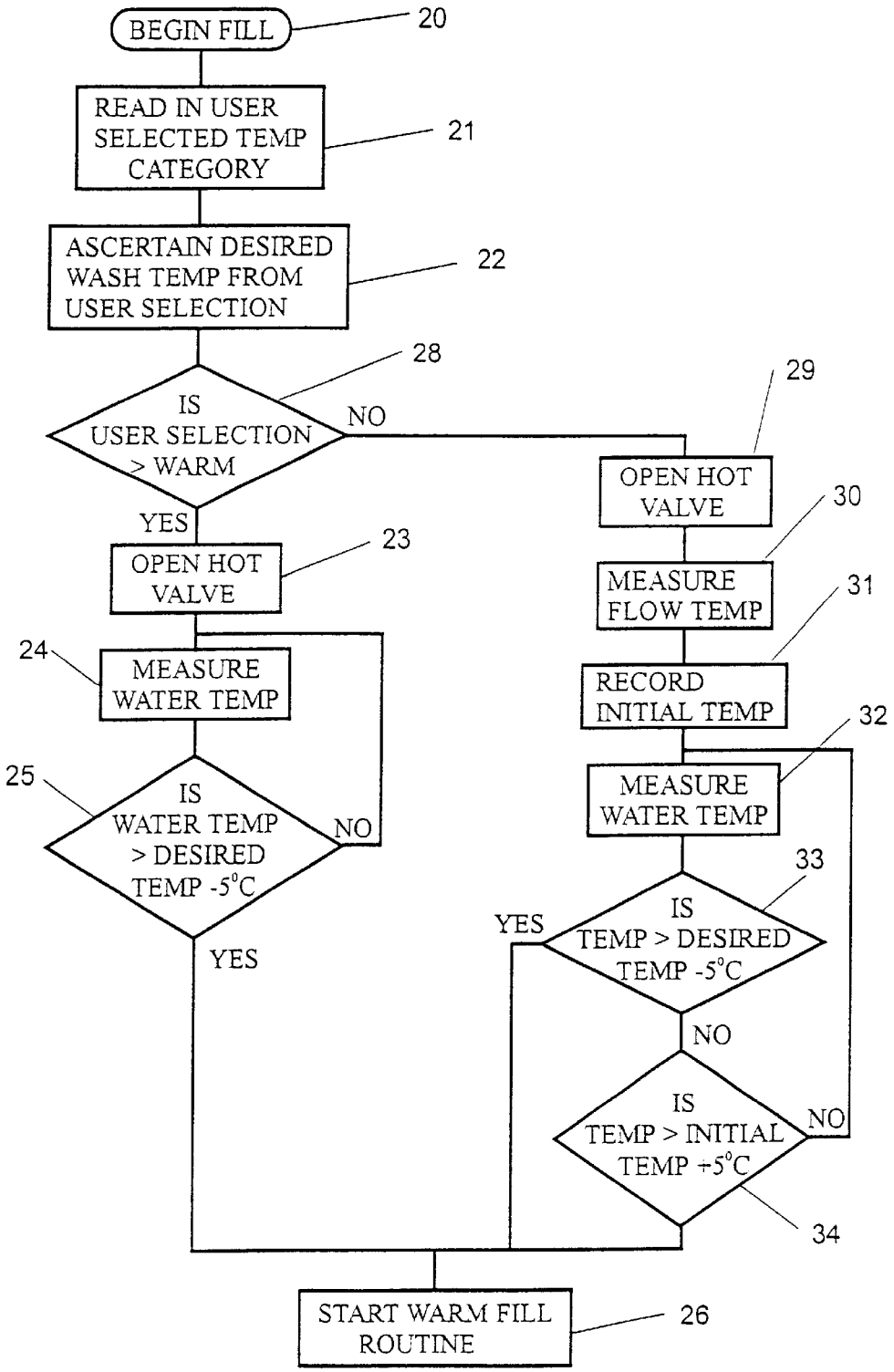
FIG. 2 is a flow chart showing the initial steps of operation of the preferred wash water inlet process according to the present invention.

Referring now to FIG. 2 the present invention reduces the impact of the cold slug on the eventual wash temperature by ensuring that, until the cold slug has been admitted to the machine, only the hot valve is open.

In a preferred form of the invention the washing machine includes electrically activated hot and cold water inlet valves, a temperature sensor located in a mixing chamber which receives water from the hot and cold inlet valves and releases the water into the tub of the washing machine. The temperature sensor is preferably located at a position where the water flow in the mixing chamber has substantially mixed so that the temperature recorded by the temperature sensor represents the temperature of the mixed flow entering the washing machine tub. Operation of the hot and cold valves is preferably controlled by a micro-processor receiving as one of its inputs the output of the temperature sensor. It will be appreciated that alternative arrangements are possible. For example the hot and cold water valves may be either binary or proportional valves, the temperature sensor may be located directly in the wash tub and the control system according to the present invention may be embodied in a hard wired electrical circuit rather than as a programme executed by a micro-processor. However with the growing use of microprocessors for, amongst other things, motor control a present microprocessor may include control of the ingressive water through the hot and cold water valves as part of its function.

In that regard filling of the washing machine begins at step 20. Firstly at step 21 the user selected temperature category (generally selected from, for example, cold, warm or hot, but may be in intermediate stages such as warm/hot or warm/cold) is read in. This temperature category is used at step 22 to ascertain from a look-up table the desired wash temperature according to the user's selection. This look-up table may record, for example, wash temperatures associated with each of the temperature settings.

In the preferred embodiment of the present invention the water temperature is sensed in a mixing chamber supplied directly by the hot and cold valves. The mixing chamber contains only a small volume of water and generally follows the temperature of the inlet water mixture on a more or less instantaneous basis. The mixed water runs from the mixing chamber directly into the machine.

At step 23 the hot valve of the machine is opened. At step 24 the water temperature in the mixing chamber is measured.

At step 25 the measured water temperature is compared to a first threshold temperature related to the desired temperature. This temperature may be, for example, a temperature within a specified threshold of the desired temperature. In that regard, in the preferred form, this temperature is 5° C. less than the desired temperature. If the water temperature is greater than the threshold temperature (the desired temperature −5° C.) we proceed directly to step 26 and start a standard warm fill routine. If the measured water temperature is less than the threshold temperature (the desired temperature −5° C.) we return by loop 27 to proceed again to step 24. Steps 24 and 25 are performed repeatedly until the measured water temperature is greater than the threshold temperature.

In the preferred form of the invention as depicted in FIG. 2, in addition to the first threshold temperature, a second criteria is also used. In particular after ascertaining the user's selections and desired temperatures at steps 21 22, a selection between alternative methods is made at step 28. In particular if the user's selection of wash temperature category is greater than "warm", then we proceed along the same method as has already been described, that is we proceed to step 23. However if the user's selection is not greater than "warm" i.e. is warn or less than "warm", then we proceed instead to step 29. At step 29 the hot valve is opened. The temperature of the water flow, being the temperature in the mixing chamber, is then measured at step 30. This measured temperature is recorded as the initial temperature at step 31.

We then perform a loop of measuring the present water temperature in the flow mixing chamber (step 32), comparing the measured temperature to the first threshold temperature (for example the desired temperature −5° C.) at step 33 and comparing the present temperature with a second threshold temperature related to the recorded initial temperature at step 34. This second threshold temperature may, for example, be a set amount (say 5° C.) greater than the recorded initial temperature. If in either of steps 33 or 34 the current temperature is greater than the respective threshold temperature, then we proceed to step 26 and start the warm fill routine.

However if neither of the two threshold temperatures is exceeded, then we proceed to repeat the loop of steps 32–34.

It will be appreciated that the above describes two preferred and simple methods for detecting the end of the cold slug using threshold temperatures. Various methods can be used for detecting the end of the cold slug using the temperature increase of the water existing the hot valve as an indicator without departing from the intended scope of the present invention. Furthermore in an alternative embodiment the step of monitoring for the cold slug duration may be conducted only once, in a calibration operation, and this duration recorded and used subsequently is an indicator of the cold slug duration during which time the cold valve is not operated unless the temperature sensor indicates that the desired wash temperature has been reached.

This preferred form has the advantage that where a user has selected a wash temperature category of warm or less, which indicates the presence of clothes of a delicate nature (e.g. susceptible to shrinkage or dye loss), there is a much reduced likelihood of water at a high temperature being admitted onto the clothes load for a short period of time. This may otherwise occur due to the likelihood that the temperature of the hot water supply will rapidly increase from cold to completely hot.

In the present invention, for convenience, it is suggested that having admitted the cold slug without the cold tap running simultaneously, it will generally be sufficient to then run a standard warm fill routine. Standard wall fill routines, for example, open the hot valve fully and make a best guess for the degree of opening, or of a pulse width modulation duty cycle, for the cold valve to obtain the appropriate supply temperature, and then adjust the degree of opening of the cold valve (or the POM duty cycle) thereof in accordance with feedback from the temperature sensor.

It is possible that in addition to this, account could be taken of the duration of the cold slug, being the time between opening the hot valve and reaching the threshold temperature, and this information could be used to compensate for the cold slug water admitted to the machine. For example, an assumption could be made that a largely steady water supply pressure of both hot and cold water and water supply temperature of both hot and cold water is likely. The machine can then be calibrated to know the approximate hot and cold water temperatures and relative water pressures. This could be achieved by, for example, running the hot tap for sufficient time to ensure hot water is being supplied, then measuring the hot water temperature, running the cold tap and measuring the cold water temperature, and running both taps and assessing the relative water pressures based on the temperature of the mixture with both taps ally on (for example if the pressures are equal then the mixture temperature will be halfway between the hot and cold temperatures). This information may be recorded by the machine for future use in compensating for the addition of the cold slug.

This compensation may be performed for example by, in a high temperature wash mode, supplying neat hot water for a period obtained by multiplying the cold slug period by the fraction of the hot water to cold water of the desired mixture. Alternatively for lower wash temperatures a compensation may be made by increasing the warm fill temperature by a predetermined amount for a period determined by the duration of the cold slug.

However, without including an additional flow rate measurement device in the machine it will be difficult to accurately determine the volume of cold slug admitted to the machine in any particular wash cycle as the temperature of the hot and cold supply fluctuate, as do, and probably to a greater extent, the pressures both relative and absolute, of the hot and cold supply. In those circumstances it is considered that attempting to compensate for the volume of the cold slug will be of unreliable benefit over and above minimizing its effect.

What is claimed is:

1. A laundry machine including a washing enclosure to which a supply of water is admitted in use, first and second valve means for connection to hot and cold water supply sources respectively, temperature sensing means which sense the temperature of either a combined water flow from the first and second valves or the water collected in the water enclosure, and a controller which, in a washing operation, executes an initial fill program comprising the steps of opening only the hot water valve and monitoring the temperature indicated by the temperature sensing means, followed by a warm fill program once the sensed temperature has reached or exceeded a threshold temperature.

2. A laundry machine as claimed in claim 1 wherein said threshold temperature is a pre-set temperature read from memory in accordance with wash parameters selected by a user or determined by the laundry machine.

3. A laundry machine including a washing enclosure to which a supply of water is admitted in use, first and second valve means for connection to hot and cold water supply sources respectively, temperature sensing means which sense the temperature of either a combined water flow from the first and second valves or the water collected in the water enclosure, and control means which, in a washing operation, perform the steps of opening the hot water valve and monitoring the temperature indicated by the temperature sensing means, and only opening the cold valve once the sensed temperature has reached or exceeded a threshold temperature wherein said thresold temperature is calculated based on the initial temperature of the supply of water flowing through said first valve.

4. A laundry machine as claimed in claim 3 wherein said threshold temperature is calculated as a preset amount greater than said initial temperature and said preset amount is read from memory in accordance with wash parameters selected by user or determined by the laundry machine.

5. A laundry machine as claimed in claim 3 wherein said temperature sensing means senses the temperature of the combined flow from the first and second valves.

6. A laundry machine as claimed in claim 5 wherein said control means records the period between turning on said hot valve and said preset threshold or condition being satisfied, said period being a cold slug period, and said controller determines a desired temperature for the combined flow of said valves at least in part on the basis of said cold slug period.

7. A laundry machine as claimed in claim 3 wherein said control means performs the additional step of recording the length of time from turning on said hot water valve to the time of said temperature reaching said threshold temperature.

8. A laundry machine including a washing enclosure to which a supply of water is admitted in use, first and second valve means for connection to hot and cold water supply sources respectively, temperature sensing means which sense the temperature of either a combined water flow from the first and second valves or the water collected in the water enclosure, and control means which, in a washing operation, perform the steps of determining a wash temperature, opening the hot water valve and monitoring the temperature indicated by the temperature sensing means, and only opening the cold valve once the sensed temperature has reached or exceeded a threshold temperature, said threshold temperature being less than said wash temperature.

9. A laundry machine as claimed in claim 8 wherein said threshold temperature is a pre-set temperature read from memory in accordance with wash parameters selected by a user or determined by the laundry machine.

10. A laundry machine as claimed in claim 8 wherein said threshold temperature is calculated based on the initial temperature of the supply of water flowing through said first valve.

11. A laundry machine as claimed in claim 10 wherein said threshold temperature is calculated as a preset amount greater than said initial temperature and said preset amount is read from memory in accordance with wash parameters selected by user or determined by the laundry machine.

12. A laundry machine as claimed in claim 10 wherein said temperature sensing means senses the temperature of the combined flow from the first and second valves.

13. A laundry machine as claimed in claim 12 wherein said control means records the period between turning on said hot valve and said preset threshold or condition being satisfied, said period being a cold slug period, and said controller determines a desired temperature for the combined flow of said valves at least in part on the basis of said cold slug period.

14. A laundry machine as claimed in claim 10 wherein said control means performs the additional step of recording the length of time from turning on said hot water valve to the time of said temperature reaching said threshold temperature.

15. A laundry machine as claimed in claim 1 wherein said threshold temperature is calculated based on the initial temperature of the supply of water flowing through said first valve.

16. A laundry machine as claimed in claim 15 wherein said temperature sensing means senses the temperature of the combined flow from the first and second valves.

17. A laundry machine as claimed in claim 1 wherein said threshold temperature is calculated as a preset amount greater than said initial temperature and said preset amount is read from memory in accordance with wash parameters selected by user or determined by the laundry machine.

18. A laundry machine as claimed in claim 1 wherein said temperature sensing means senses the temperature of the combined flow from the first and second valves.

19. A laundry machine as claimed in claim 18 wherein said control means records the period between turning on said hot valve and said threshold temperature being satisfied, said period being a cold slug period, and said controller determines a desired temperature for the combined flow of said valves at least in part on the basis of said cold slug period.

20. A laundry machine as claimed in claim 1 wherein said control means performs the additional step of recording the length of time from turning on said hot water valve to the time of said temperature reaching said threshold temperature.

* * * * *